US007070077B2

(12) United States Patent
Egart et al.

(10) Patent No.: US 7,070,077 B2
(45) Date of Patent: Jul. 4, 2006

(54) BACKPACK

(75) Inventors: John Egart, Andover, MN (US); Gregory D. Myers, Oak Grove, MN (US)

(73) Assignee: Buckman Imports, Inc., Andover, MN (US)

( * ) Notice: Subject to any disclaimer, the term of this patent is extended or adjusted under 35 U.S.C. 154(b) by 0 days.

(21) Appl. No.: 10/766,788

(22) Filed: Jan. 28, 2004

(65) Prior Publication Data

US 2005/0161485 A1 Jul. 28, 2005

(51) Int. Cl.
*A45F 3/02* (2006.01)

(52) U.S. Cl. ..... 224/625; 224/626; 224/608

(58) Field of Classification Search ..... 224/625, 224/626, 257, 258, 600, 605, 607, 608, 637–641, 224/578, 579; 119/792
See application file for complete search history.

(56) References Cited

U.S. PATENT DOCUMENTS

| | | | | |
|---|---|---|---|---|
| 1,137,303 A | | 4/1915 | Carpenter | |
| 1,302,312 A | * | 4/1919 | Cook | 224/618 |
| 2,224,568 A | * | 12/1940 | Altorfer | 224/625 |
| 2,691,399 A | * | 10/1954 | Tompkins | 224/625 |
| 2,781,808 A | * | 2/1957 | Barnard | 224/626 |
| 4,561,576 A | | 12/1985 | Lowe et al. | 224/209 |
| 4,810,102 A | | 3/1989 | Norton | 383/4 |
| 4,887,751 A | * | 12/1989 | Lehman | 224/626 |
| 5,012,964 A | | 5/1991 | Falletta et al. | 224/153 |
| 5,228,609 A | * | 7/1993 | Gregory | 224/625 |
| 5,577,652 A | | 11/1996 | Cooper | 224/578 |
| 5,769,295 A | * | 6/1998 | Alves | 224/578 |
| 5,873,506 A | | 2/1999 | Golling et al. | 224/645 |
| 5,893,503 A | * | 4/1999 | Jean | 224/626 |
| 5,950,894 A | | 9/1999 | Haber | 224/627 |
| 5,957,354 A | | 9/1999 | Mentken | 224/612 |
| 6,053,381 A | | 4/2000 | Fahl et al. | 224/153 |
| 6,226,844 B1 | | 5/2001 | Lerra et al. | 24/625 |
| 6,367,674 B1 | | 4/2002 | Tabor | 224/650 |

FOREIGN PATENT DOCUMENTS

| | | |
|---|---|---|
| DE | 9414967 | 1/1995 |
| WO | WO 00/62643 | 10/2000 |

* cited by examiner

*Primary Examiner*—Nathan J. Newhouse
*Assistant Examiner*—Justin M. Larson
(74) *Attorney, Agent, or Firm*—Z. Peter Sawicki; Westman, Champlin & Kelly, P.A.

(57) ABSTRACT

A backpack includes a bag portion and only one shoulder strap connected to the bag portion at a first end. The backpack also includes left and right side straps wherein each side strap is connected to the bag portion also at a first end. The only one shoulder strap and the left and right side straps are each connected to a central member at second ends and wherein at least one of the side straps is detachably attached to the central member.

9 Claims, 2 Drawing Sheets

16
28
14
30
54
10
52
12
50
18
20

BACKPACK

BACKGROUND OF THE INVENTION

The present invention relates to backpacks, and more particularly, to a backpack that is easy to put on and take off. Backpacks have become very popular and are used by students, people in the workplace, and individuals in general for carrying items in a convenient manner. One problem with conventional backpack assemblies is that individuals such as elderly or others with certain physical and medical handicaps find it difficult to wear and remove a backpack.

The backpack described in the Haber U.S. Pat. No. 5,950,894 is one solution to a backpack that is more easily put on and removed.

Another backpack described in the Golling et al. U.S. Pat. No. 5,873,506 describes a backpack that permits a user more freedom of movement since the shoulder straps extend in a crosswise manner over the chest of the user and are attached at lower ends to the lower portions of the bag portion of the backpack.

SUMMARY OF THE INVENTION

The present invention includes a backpack comprising a bag portion and only one shoulder strap connected at a first end to the bag portion. The backpack also includes left and right side straps wherein each side strap is also at a first end connected to the bag portion. The only one shoulder strap and the left and right side straps are each connected to a central member at second ends and wherein at least one of the side straps is detachably attached to the central member.

DETAILED DESCRIPTION

Figure 1:
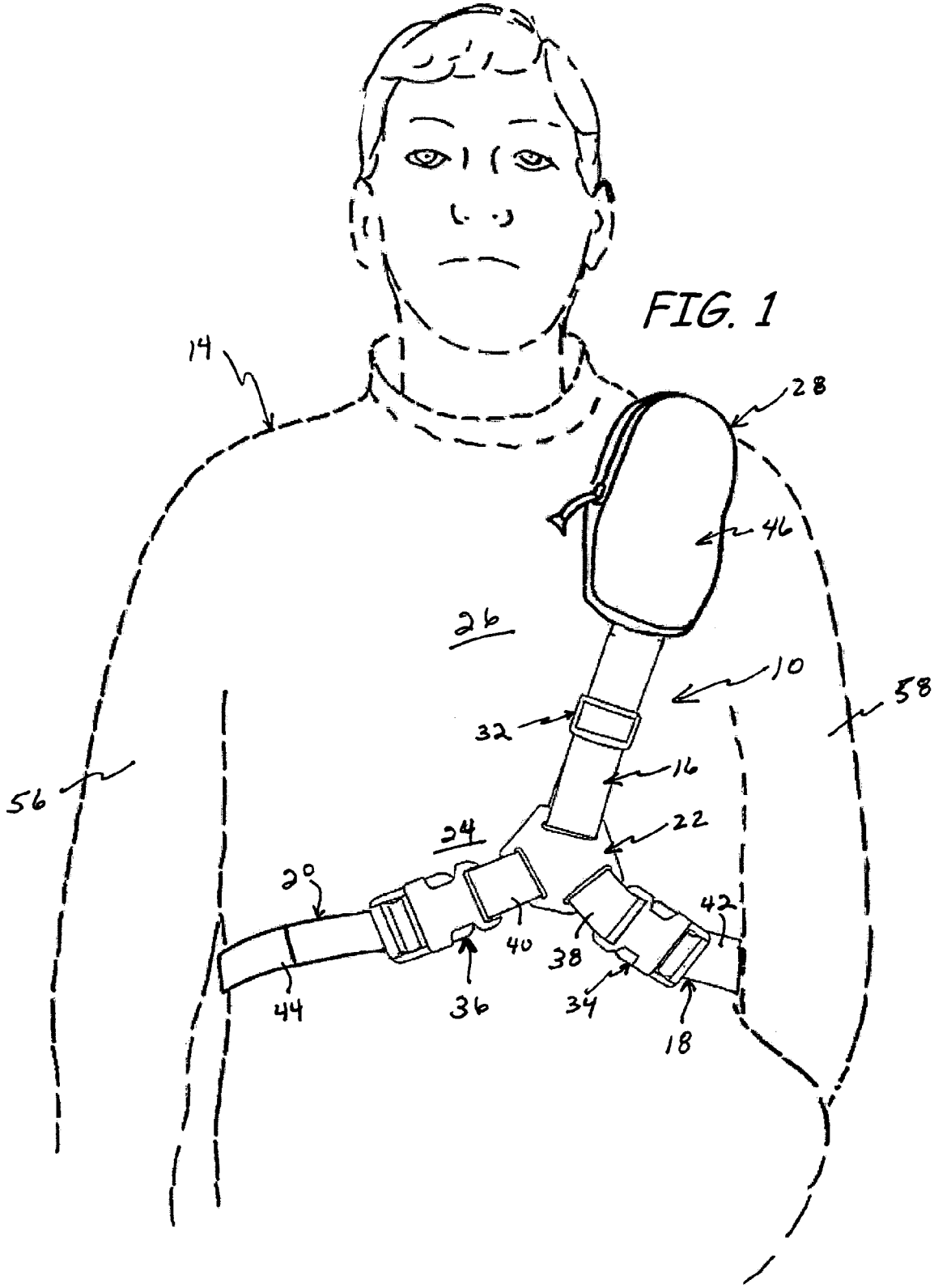
FIG. 1 is a front elevational view of the backpack of the present invention on a person.
Figure 2:
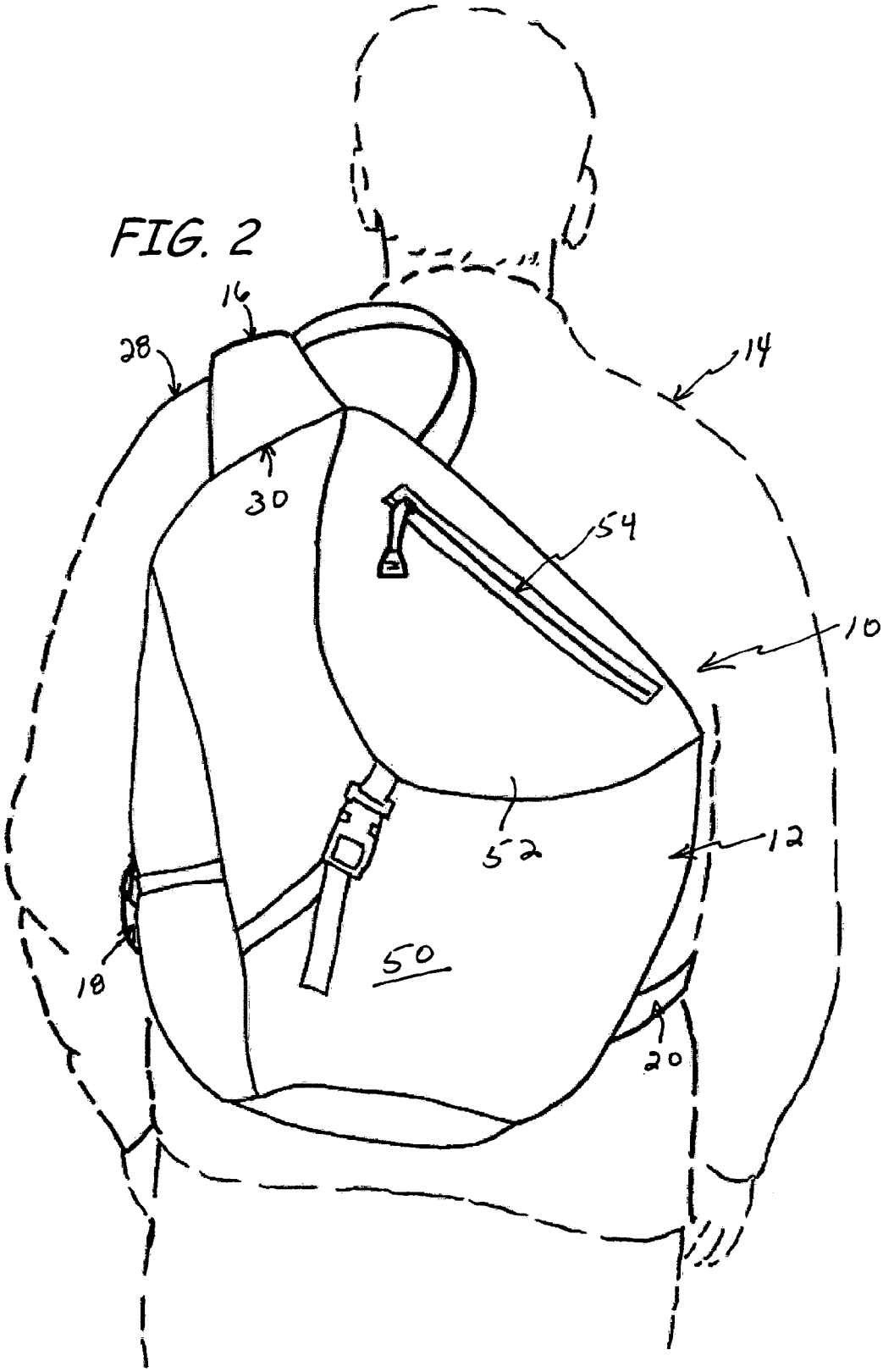
FIG. 2 is a rear elevational view of the backpack of the present invention on the person.

The backpack of the present invention is generally illustrated at 10 in FIGS. 1 and 2. The backpack 10 includes a bag portion 12 that is worn by a person (illustrated in broken lines) 14. The backpack 10 is worn utilizing only three straps. The straps include one shoulder strap 16, and a left and a right stabilizing strap 18 and 20, respectively. The straps 16, 18 and 20 are connected by a central connector 22. The central connector 22 is disposed approximately the person's 14 mid-section 24 just below the chest area 26.

The shoulder strap 16 extends from the connector 22 across the left shoulder 28 and is secured to the bag portion 12 at an upper left hand comer 30, as best illustrated in FIG. 2.

Shoulder strap 16 is adjustable in length through length adjustment buckle 32. Such buckles are well known in the art and by pulling the strap 16 through the buckle 32, the strap 16 may be shortened or increased in length. Although the shoulder strap 16 is illustrated extending over the left shoulder, the shoulder strap may be created to also extend over the right shoulder. If the shoulder strap 16 extends over the right shoulder, the shoulder strap will then have to be attached to a right comer of the bag portion 12. In this alternative embodiment, the bag portion is a mirror image of the bag portion 12 illustrated in FIG. 2.

The stabilizing straps 18 and 20 extend around the person 14 just above the hips, extending from the central connector 22, to which the straps are connected at one end, as best illustrated in FIG. 1 rearwardly above the hips of the person 14. The straps 18 and 20 are then connected to the bag portion 12 along a lower section thereof, as best illustrated in FIG. 2.

Each stabilizing strap 18 and 20 has a separating buckle 34 and 36, respectively. The separating buckles are side release quick connect and disconnect buckles which are well known in the art. One example of such a buckle is more specifically described in U.S. Pat. No. 6,226,844 which is herein incorporated by reference. The separating buckles 34 and 36 separate into two halves (the separation not being illustrated in the drawings), thereby disconnecting either stabilizing strap 18 or 20 from the connector 22. The buckles 34 and 36 are preferably attached at one end to the connector 22 by strap portions 38 and 40, respectively. At another end, the stabilizing straps include strap portions 42 and 44 which are attached to the other end of the buckles 34 and 36, respectively, with the strap portions 42 and 44 extending along the person's left and right hips, and being attached at another end to the bag portion 12, as best illustrated in FIG. 2.

The backpack 10 may include a front shoulder pouch 46 attached to the shoulder strap 16 and which when worn, rests just below a front left shoulder area 28 of the person 14. The bag portion 12, as best illustrated in FIG. 2 includes a main compartment 50, whose opening is covered by flap 52. Flap 52 also serves as another storage compartment having an opening accessed by zipper 54.

The backpack 10 of the present invention is easily taken off or put on due to the single shoulder strap construction. Typically, the stabilizing strap 16 is detached from the connector 22 through buckle 36. The person 14 then places a left arm 56 between the stabilizing strap 20 and the shoulder strap 16. The bag portion 12 of the backpack 10 will then lie over the person's back. The stabilizing strap 20 is then reconnected to the connectors 22 through buckle 36.

Similarly, both buckles 34 and 36 may be separated thereby disconnecting both stabilizing straps 18 and 20 from the connector 22. The bag portion 12 of the backpack 10 is easily slung to the front of the person 14 by holding onto strap 16 with the left arm 58 just above the connector 22.

Although the present invention has been described with reference to preferred embodiments, workers skilled in the art will recognize that changes may be made in form and detail without departing from the spirit and scope of the invention.

What is claimed is:

1. A backpack comprising:

a bag portion;

only one shoulder strap connected at a first end to the bag portion;

left and right side straps, each side strap connected at a first end to the bag portion;

left and right buckles attached to the left and right straps; and a central member wherein the only one shoulder strap and the left and right side straps are each connected to the central member at second ends opposite from the first ends, each side strap connected to the central member through the buckles which separate into first and second portions with the first portion being attached to the central member and the second portion being attached to the respective side strap such that either or both side straps are attachable and detachable to the central member through separation of the buckles.

2. The backpack of claim 1 wherein the shoulder strap is adjustable in length.

3. A method of donning a backpack on a wearer, the backpack including a bag portion extending over a wearer's back, and only one shoulder strap extending over a shoulder of the wearer, and two side straps extending around the wearer's mid-section, the only one shoulder strap and the two side straps being connected to a connector disposed proximate the wearer's mid-section, the side straps connected to the connector through buckles that separate into first and second portions with the first portion being attached to the connector and the second portion being attached to the respective side strap, the method comprising: placing the bag portion on a wearer's back while at least one of the side straps is disconnected from the connector; positioning the connector proximate the wearer's mid-section; and connecting the at least one disconnected side strap to the connector.

4. The method of claim 3 and further comprising keeping the other side strap attached during donning or removing.

5. The method of claim 3 wherein the side strap that is detached or attached is on the same side of the person as the shoulder strap.

6. The method of claim 3 wherein the side strap is being detached or is being attached to a connector positioned proximate the person's chest.

7. A method of removing a backpack from a wearer, the backpack including a bag portion extending over the wearer's back, and only one shoulder strap extending over a shoulder of the wearer, and two side straps extending around the person's mid-section, the only one shoulder strap and the two side straps being connected to a connector disposed proximate the wearer's mid-section, the side straps connected to the connector through buckles that separate into first and second portions whith the first portion being attached to the connector and the second portion being attached to the respective side strap, the method comprising:

disconnecting one of the side straps from the connector by separating the respective buckle into first and second portions;

grabbing a portion of the shoulder strap proximate the connector; and removing the bag portion from the wearer's back by extending away from the body the arm that has grabbed the shoulder strap.

8. The method of claim 7 wherein both side straps are disconnected.

9. The method of claim 8 wherein both side straps are disconnected by separating each buckle into first and second portions.

* * * * *